US006591433B1

(12) United States Patent
Sager

(10) Patent No.: US 6,591,433 B1
(45) Date of Patent: Jul. 15, 2003

(54) COMBINATION SIMULATED PALM TREE AND SHOWER DEVICE

(75) Inventor: Michael J. Sager, Crestwood, MO (US)

(73) Assignee: Caleco Creatives, Inc., St. Louis, MO (US)

( * ) Notice: Subject to any disclaimer, the term of this patent is extended or adjusted under 35 U.S.C. 154(b) by 22 days.

(21) Appl. No.: 09/636,174

(22) Filed: Aug. 10, 2000

(51) Int. Cl.[7] ..... A47K 3/022
(52) U.S. Cl. ..... 4/615; 239/279
(58) Field of Search ..... 4/494, 496, 596–599, 4/601, 602, 603, 615, 616; 428/18; 239/279; 135/16

(56) References Cited

U.S. PATENT DOCUMENTS

| | | | | | |
|---|---|---|---|---|---|
| 919,157 | A | * | 4/1909 | Glaser | 4/494 X |
| 1,516,226 | A | * | 11/1924 | Wixom | 4/615 X |
| 2,251,705 | A | | 8/1941 | Gonzalez | 428/18 X |
| 3,067,950 | A | * | 12/1962 | Goldman | 239/279 X |
| 5,085,900 | A | | 2/1992 | Hamlett | 428/18 |
| 5,135,440 | A | | 8/1992 | Smollar et al. | 472/128 |
| 5,979,793 | A | * | 11/1999 | Louis | 4/615 X |
| 5,983,419 | A | | 11/1999 | Carroll | 4/615 |

FOREIGN PATENT DOCUMENTS

| | | | | |
|---|---|---|---|---|
| FR | 1453606 | * | 9/1966 | 4/616 |

* cited by examiner

*Primary Examiner*—Robert M. Fetsuga
(74) *Attorney, Agent, or Firm*—Polster, Lieder, Woodruff & Lucchesi, L.C.

(57) ABSTRACT

A combination simulated palm tree and shower device comprises a base, a support structure positioned within the base, the support structure having an opening, a post having a lower end and an upper end, the lower end being positioned within the opening of the support structure, a hose having a first end and a second end, the hose being inserted into the post with the first end extending out of the upper end of the post and the second end extending out of the lower end of the post and out of the base, an outer casing adapted to be placed over the post, the outer casing having an opening through which the first end of the hose is inserted, a shower head being connected to the first end of the hose, and an umbrella adapted to being inserted into the upper end of the post, the umbrella and outer casing forming the simulated palm tree.

10 Claims, 2 Drawing Sheets

COMBINATION SIMULATED PALM TREE AND SHOWER DEVICE

CROSS REFERENCE TO RELATED APPLICATIONS

STATEMENT REGARDING FEDERALLY SPONSORED RESEARCH OR DEVELOPMENT

BACKGROUND OF THE INVENTION

This invention relates to a movable plumbing fixture for use as a shower and more particularly to a combination simulated palm tree and shower device.

Outdoor showers are useful devices for numerous reasons. In particular, an outdoor shower may be used prior to or after use of a swimming pool, a hot tub, or a sauna. Another use for an outdoor shower is to cool down or clean off an individual after exercising, running, or performing yard work. Showers are also located at the beach and help an individual to remove sand from their clothing and body. However, known showers that are located at the pool or the beach are typically permanent structures which are attached by pipes to a water source or supply. Additionally, such showers are typically utilitarian in nature and generally lack any eye catching or exciting quality. Although these showers are useful, they are not aesthetically pleasing, are not movable, and are tied directly to the water supply. Further, these showers require maintenance and during cold weather need to be serviced and disconnected to prevent freezing of the pipes.

The present invention is designed to obviate and overcome many of the disadvantages and shortcomings associated with present showers. In particular, the present invention is a combination simulated palm tree and shower device that may be easily constructed and installed at various locations. Moreover, the combination simulated palm tree and shower device of the present invention is durable and can withstand prolonged exposure to the weather if installed outside and is easy to handle and move from an outside location for storage.

BRIEF SUMMARY OF THE INVENTION

In one form of the present invention, a combination simulated palm tree and shower device comprises a base, a support structure positioned within the base, the support structure having an opening, a post having a lower end and an upper end, the lower end being positioned within the opening of the support structure, a hose having a first end and a second end, the hose being inserted into the post with the first end extending out of the upper end of the post and the second end extending out of the lower end of the post and out of the base, an outer casing adapted to be placed over the post, the outer casing having an opening through which the first end of the hose is inserted, a shower head being connected to the first end of the hose, and an umbrella adapted to being inserted into the upper end of the post, the umbrella and outer casing forming the simulated palm tree.

In another form of the present invention, a combination simulated palm tree and shower device comprises a simulated palm tree structure having a hollow trunk and an umbrella simulating branches with the umbrella being positioned in the hollow trunk, a support structure for supporting the simulated palm tree structure in an upright position, a shower system for providing water to an upper portion of the simulated palm tree structure, the shower system comprising a hose which is inserted through the hollow trunk, and a water discharge device connected to an end of the hose which is positioned at the upper portion of the simulated palm tree structure.

In yet another form of the present invention, a combination simulated palm tree and shower device comprises a simulated palm tree structure having a hollow trunk and an umbrella simulating branches with the umbrella being positioned in the hollow trunk, a support structure for supporting the simulated palm tree structure in an upright position, a shower system for providing water to an upper portion of the simulated palm tree structure, the shower system comprising a hose which is inserted through the hollow trunk, a Y connector device connected to an end of the hose which is positioned at the upper portion of the simulated palm tree structure, a first water discharge device connected to one end of the Y connector device and a second water discharge device connected to another end of the Y connector device.

In light of the foregoing comments, it will be recognized that a principal object of the present invention is to provide a combination simulated palm tree and shower device which is of simple construction and design and which can be easily employed with highly reliable results.

Another object of the present invention is to provide a combination simulated palm tree and shower device that is easy to transport, move, or store for use in both residential and commercial applications or locations.

A further object of the present invention is to provide a combination simulated palm tree and shower device which is capable of being manufactured using commonly available components which are relatively inexpensive.

Another object of the present invention is to provide a combination simulated palm tree and shower device that requires little or no maintenance and is constructed using durable parts or components.

These and other objects and advantages of the present invention will become apparent after considering the following detailed specification in conjunction with the accompanying drawings, wherein:

DETAILED DESCRIPTION OF INVENTION

Figure 1:
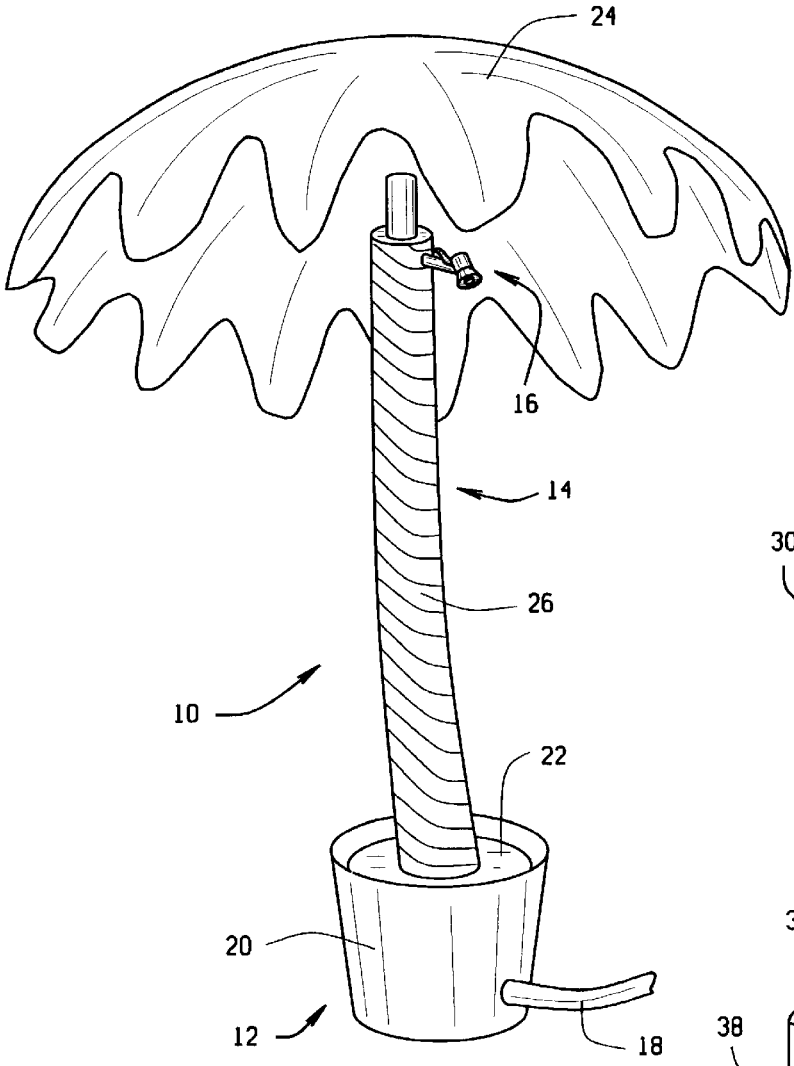
FIG. 1 is a perspective view of a preferred embodiment of a combination simulated palm tree and shower device constructed according to the present invention.

Referring now to the drawings, wherein like numbers refer to like items, number 10 identifies a preferred embodiment of a combination simulated palm tree and shower device 10 constructed according to the present invention.

With reference now to FIG. 1, the device 10 comprises a base 12, a simulated palm tree structure 14, a water discharge device 16, and a hose or water conduit 18. The base 12 is in the form of a plant box 20 which includes rock 22 placed in the plant box 20 to weigh the device 10 down to prevent or limit movement. Although rock 22 is shown, it is also possible to place sand in the box 20 or a combination of rock 22 and sand. Additionally, bark may be placed on the top of the rock 22 to further enhance the appearance of the device 10.

The simulated palm tree structure 14 includes an umbrella 24 positioned at the top of the structure 14. The umbrella 24 is shaped and colored to simulate palm leaves or fronds and may include an illustration of palm leaves thereon. The umbrella 24 also serves as a sun shade while using the device 10. The simulated palm tree structure 14 further includes a trunk portion 26 or outer casing which may be constructed of drainage pipe. In this construction, the trunk portion 26 may be painted a bark color to further create the illusion of a real palm tree trunk.

Figure 2:
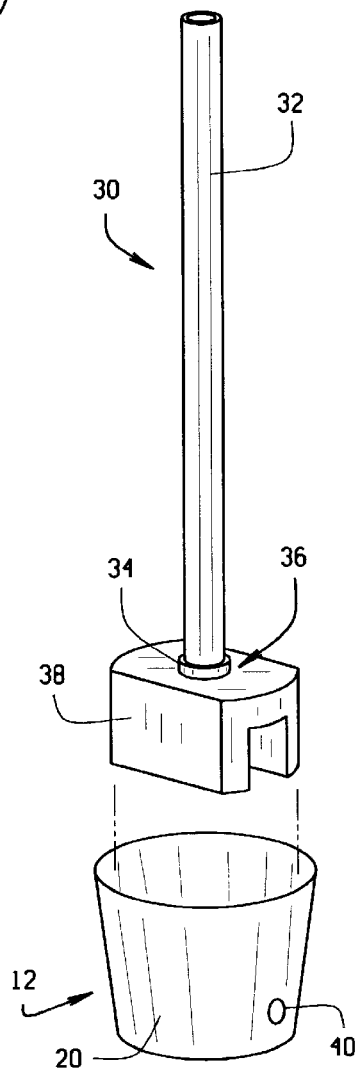
FIG. 2 is a perspective view of a support structure prior to being inserted into a base.

FIG. 2 shows a perspective view of an internal support structure 30 being inserted into the base 12. The support structure 30 was not visible in FIG. 1 due to the support structure 30 being hidden beneath the trunk portion 26, as will be explained. The support structure 30 comprises a hollow post 32, such as a pipe, a tube, or a conduit, which may be made of PVC (polyvinyl chloride) or other rigid material. The hollow post 32 is inserted into a tee 34 with the tee 34 being fitted through an opening 36 of a base support structure 38. The opening 36 is sized and shaped so that the tee 34 is held in place by friction or nails, glue, cement, bolts, screws, or other fastening means may be used to secure the tee 34 to the base support structure 38. The tee 34 may also be manufactured of PVC or a plastic material. The base support structure 38 may be constructed of any suitable material and is shaped to have some of the sides of the structure 38 fit snugly against the interior wall of the box 20. It is also possible to have all of the sides of the structure 38 fit against the interior wall of the box 20. Additionally, the box 20 may be a flower pot which is used to hold flowers or plants. The post 32, the tee 34, and the base support structure 38 are adapted to fit into the box 20 of the base 12.

The base 12 is also shown to have an opening 40 through which may be inserted the hose 18.

Figure 3:
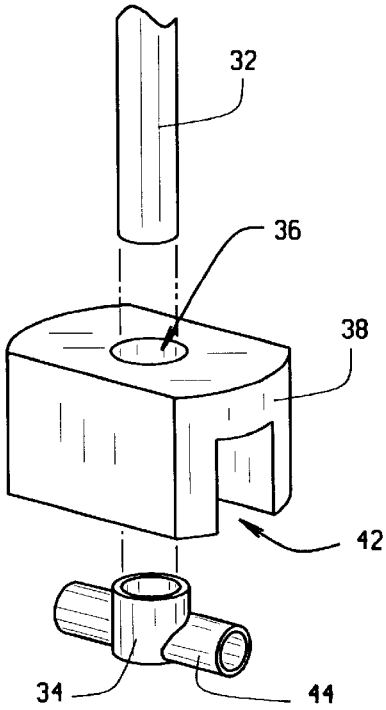
FIG. 3 is an enlarged and partial exploded view of the support structure with portions cut away to reveal details thereof.

With reference now to FIG. 3, a more detailed view of the support structure 30 is depicted. In particular, the tee 34 is shown to be positioned on an underside of the structure 38. The tee 34 is hollow and is adapted to have the hose 18 inserted therein and through and then up into the post 32. The structure 38 also has an open side 42 which is positioned to be adjacent to the opening 40 in the box 20. This allows the hose 18 to be easily inserted into the box 20 into the tee 34 and up through the post 32. The tee 34 may be as wide as the structure 38 in order to have one leg 44 of the tee 34 mate with the opening 40. This will allow the hose 18 to be completely enclosed and any rock 22 which is placed in the box 20 will not be able to crush the hose 18. As is known, the PVC post 32 may be secured to the tee 34 by using a suitable adhesive or cement. However, other known securing methods may be used, such as screws, bolts, or even frictional engagement.

Figure 4:
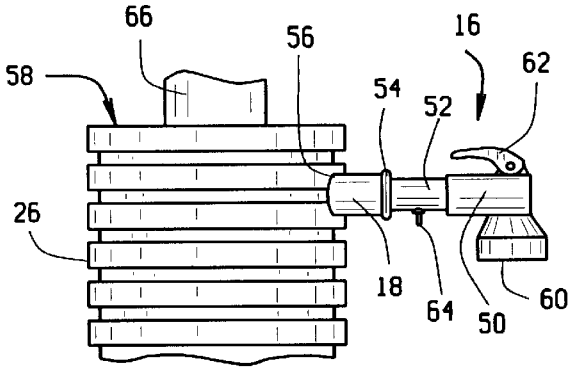
FIG. 4 is an enlarged partial perspective view of the water discharge device shown in FIG. 1.

Referring now to FIG. 4, the construction and details of the water discharge device 16 are shown. The water discharge device 16 comprises a shower head 50 which may be connected to a shut off valve 52, which in turn is connected to one end 54 of the hose 18. The end 54 of the hose 18 is extended out of the trunk 26 through an opening 56 formed in the trunk 26. The opening 56 is positioned at a top portion 58 of the trunk 26. The shower head 50 has a nozzle 60, a handle 62, and a pin (not shown) which is capable of holding the handle 62 in the open position. Additionally, the handle 62 may have a pull cord (not shown) attached to it in order to operate the handle 62. The valve 52 has a handle 64 which is used to control the water flow to the shower head 50. For example, when the handle 64 is in the open position, water will be able to flow to the shower head 50 and when the handle 64 is in the closed position, water will be prevented from flowing to the shower head 50. The water discharge device 16 may be constructed not including the valve 52. The nozzle 60 may be provided with the capability of being moved or rotated into different shower positions or configurations. For example, in one position the nozzle 60 will send out a mist and when the nozzle 60 is turned or dialed to another position a pulsating stream of water will be emitted.

Also shown inserted into the trunk 26 is a handle 66 of the umbrella 24. Since the trunk 26 is hollow, the handle 66 of the umbrella 24 is able to fit within the trunk 26. The umbrella 24 may further be secured to the water discharge device 16 by using a clip (not shown). The clip will ensure that the umbrella 24 will not blow away during high winds. Additionally, by securing the umbrella 24 to the water discharge device 16, the shower head 50 may be adjusted to a desired height or orientation. Although not shown, a cap could be used to cover the top portion 58 of the trunk 26. The cap would have an opening into which the handle 66 of the umbrella 24 could be inserted. The cap would prevent water from getting into the trunk 26 and the post 32.

Figure 5:
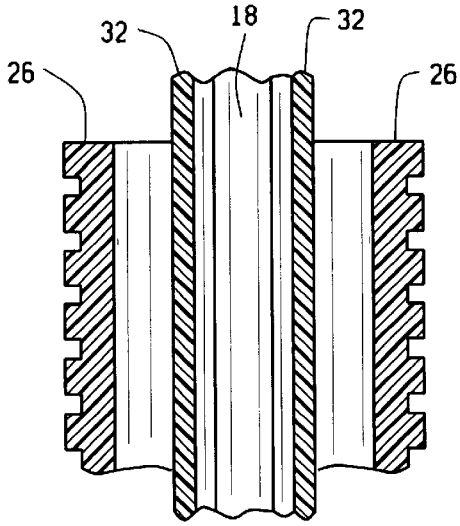
FIG. 5 is an enlarged partial cross-sectional view of the trunk portion of the combination simulated palm tree and shower device shown in FIG. 1.

FIG. 5 illustrates a cross-sectional view of the trunk 26, the post 32, and the hose 18 of the combination simulated palm tree and shower device 10. The trunk 26 is shown to be made from a section of drainage pipe. The trunk 26 is positioned over the post 32 and the hose 18 is inserted through the post 32. The diameter of the trunk 26 is larger than the diameter of the post 32 and this provides some play or movement between the trunk 26 and the post 32. This movement has the effect of simulating the swaying of a palm tree. However, it is also possible that the trunk 26 and the post 32 could be an unitary construction.

Figure 6:
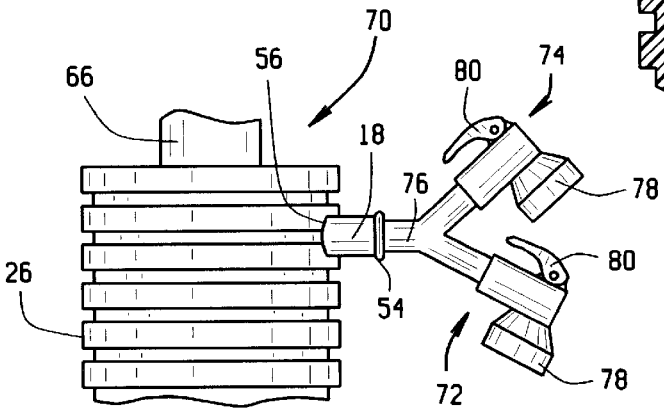
FIG. 6 is a partial perspective view of another preferred embodiment of the water discharge device constructed according to the present invention.

Turning now to FIG. 6, another preferred embodiment of a water discharge device 70 is shown. The water discharge device 70 comprises a first shower head 72 and a second shower head 74. The shower heads 72 and 74 are each connected to a Y connector device 76 which in turn is connected to the end 54 of the hose 18. The end 54 of the hose 18 is extended out of the trunk 26 through the opening 56. Each of the shower heads 72 and 74 has a nozzle 78, a handle 80, and a pin (not shown) which is capable of holding the handle 80 in the open position. Although not shown, a shut off valve, such as the valve 52 shown in FIG. 4, may be used to control the flow of water to each of the shower heads 72 and 74. Further, the Y connector device 76 may have a shut off valve incorporated therein for each leg of the Y. In this manner, operation of one or both of the shower heads 72 and 74 may be individually controlled. Additionally, the shower heads 72 and 74 may be similar shower heads or two different shower heads may be employed. The handle 66 of the umbrella 24 is also shown in FIG. 6 as being inserted into the trunk 26. As previously described, the umbrella 24 may be secured to either or both of the shower heads 72 and 74 by using a clip (not shown).

The combination simulated palm tree and shower device 10 may be constructed in the following manner. The tee 34 is mounted or secured in the opening 36 of the base support structure 38. The post 32 is then positioned into the tee 34 and secured in place. The hose 18 is inserted into the post 32 from the top of the post 32 and passed through the tee 34 out the leg 44. A portion of the hose 18, about six inches, is left protruding from the top of the post 32. The other end of the hose 18 is placed through the hole 40 in the box 20. The base support structure 38, including the post 32, the tee 34, and the hose 18, are positioned within the box 20. The box 20 may then be filled with a quantity of the rock 22. A quantity of about 40 pounds will be sufficient for this application. Additionally, as described previously, the rock 22 may be topped with shredded bark to provide the appearance of a potted palm tree. The trunk 26 is then positioned over the post 32 and the end 54 of the hose 18 is pulled through the opening 56 in the trunk 26. The valve 52 or the shower head 50 may then be threaded onto the end 54 of the hose 18. If the shower discharge device 70 is used, then the Y connector 76 may be placed on the end 54 of the hose 18. Finally, the umbrella 24 is inserted into the trunk 26 and clipped in place.

In operation, the device 10 is positioned at a desired location and a supply of water, such as provided from a garden hose, is attached to the hose 18. If the valve 52 has been attached to the end 54, the handle 64 is moved to the open position to allow water to flow to the shower head 50. The handle 62 of the shower head 50 is then opened by squeezing on the handle 62 and water flows out through the shower head 50. As described above, a pin may be used for prolonged use of the device 10 so as not to require the continued squeezing of the handle 62.

Some typical dimensions of various components of the device 10 are listed as follows. The base 12 may be a planter pot which is 12 inches tall having a 15 inch opening tapering to an 8½ inch base. The base support structure 38 may be 6½ inches tall with an 11½ wide top. The post 32 has a diameter of 1½ inches and a height of 5 feet 8 inches. The trunk 26 may be assembled from a 6 foot length of drainage pipe. Finally, the hose 18 may be a 9 foot length of garden hose. As can be appreciated, different dimensions may be used depending upon the particular application. Further, different heights and limberness of the PVC used for the post 32 and the drainage pipe used for the trunk 26 allow the device to gently sway in the breeze to further simulate a real palm tree.

It should be recognized that the combination simulated palm tree and shower device 10 of the present invention can be constructed of various materials and can be assembled from separable components or formed as a unitary construction. Preferably, the combination simulated palm tree and shower device 10 will be of relatively lightweight materials, prior to the use of the rock 22, so that it can be easily positioned and repositioned elsewhere for use. Although the preferred embodiment is in the shape of a simulated or an artificial palm tree, it should be recognized that the device 10 of the present invention may take many different forms and shapes. For example, a configuration which simulates another type tree, such as an oak tree, is possible. It is also contemplated and possible that the device 10 may be used inside a structure, such as a house. Further, although a tee 34 have been shown and described, an elbow type connector may be used.

From all that has been said, it will be clear that there has thus been shown and described herein a combination simulated palm tree and shower device which fulfills the various objects and advantages sought therefor. It will become apparent to those skilled in the art, however, that many changes, modifications, variations, and other uses and applications of the subject combination simulated palm tree and shower device are possible and contemplated. All changes, modifications, variations, and other uses and applications which do not depart from the spirit and scope of the invention are deemed to be covered by the invention, which is limited only by the claims which follow.

Having thus described the invention, what is claimed and desired to be secured by Letters Patent is:

1. A combination simulated palm tree and shower device comprising:

a base;

a support structure positioned within the base, the support structure having an opening;

a post having a lower end and an upper end, the lower end being positioned within the opening of the support structure;

a hose having a first end and a second end, the hose being inserted into the post with the first end extending out of the upper end of the post and the second end extending out of the lower end of the post and out of the base;

an outer casing adapted to be placed over the post, the outer casing having an opening through which the first end of the hose is inserted;

a shower head being connected to the first end of the hose; and an umbrella adapted to being inserted into the upper end of the post, the umbrella and outer casing forming the simulated palm tree.

2. The device of claim 1 wherein the hose is connected to a source of water to provide water through the hose to the shower head.

3. The device of claim 2 further comprising a valve connected to the shower head for controlling the flow of water through the shower head.

4. The device of claim 1 further comprising a quantity of rock for being placed into the base for holding the device in place.

5. The device of claim 1 further comprising a tee having three openings with one of the openings being positioned through the opening of the support structure and another one of the openings adapted for receiving the second end of the hose.

6. A combination simulated palm tree and shower device comprising:

a base;

a support structure positioned within the base, the support structure having an opening;

a post having a lower end and an upper end, the lower end being positioned within the opening of the support structure;

a water conduit having a first end and a second end, the water conduit being inserted into the post with the first end extending out of the upper end of the post and the second end extending out of the lower end of the post and out of the base;

an outer casing adapted to be placed over the post, the outer casing having an opening through which the first end of the hose is inserted;

a shower head being connected to the first end of the water conduit; and an umbrella adapted to being inserted into the upper end of the post, the umbrella and outer casing forming the simulated palm tree.

7. The device of claim 6 wherein the water conduit is connected to a source of water to provide water through the water conduit to the shower head.

8. The device of claim 7 further comprising a valve connected to the shower head for controlling the flow of water through the shower head.

9. The device of claim 6 further comprising a quantity of rock for being placed into the base for holding the device in place.

10. The device of claim 6 further comprising a tee having three openings with one of the openings being positioned through the opening of the support structure and another one of the openings adapted for receiving the second end of the water conduit.

* * * * *